US006683963B2

(12) United States Patent
Sterns et al.

(10) Patent No.: US 6,683,963 B2
(45) Date of Patent: Jan. 27, 2004

(54) INTERCHANGEABLE PIVOTING LOUDSPEAKER ASSEMBLY WITH SPRING RETAINED HIGH FREQUENCY TRANSDUCER

(75) Inventors: Frank Sterns, Miami, FL (US); Doug Stuart Wright, Simi, CA (US)

(73) Assignee: Niles Audio Corporation, Miami, FL (US)

( * ) Notice: Subject to any disclaimer, the term of this patent is extended or adjusted under 35 U.S.C. 154(b) by 0 days.

(21) Appl. No.: 09/943,676

(22) Filed: Aug. 31, 2001

(65) Prior Publication Data

US 2003/0044039 A1 Mar. 6, 2003

(51) Int. Cl.[7] ..... H04R 25/00

(52) U.S. Cl. ..... 381/182; 381/387

(58) Field of Search ..... 381/182, 386, 381/387, 395, 87, 332, 335, 86; 181/144

(56) References Cited

U.S. PATENT DOCUMENTS 4,577,069 A * 3/1986 Keezer
5,867,583 A * 2/1999 Hazelwood et al.

* cited by examiner

*Primary Examiner*—Sinh Tran
(74) *Attorney, Agent, or Firm*—Lott & Friedland, P.A.

(57) ABSTRACT

An interchangeable loudspeaker assembly capable of pivoting the low-frequency and high-frequency transducers to provide directional sound while avoiding hindrance of sound waves by the loudspeaker frame.

8 Claims, 7 Drawing Sheets

INTERCHANGEABLE PIVOTING LOUDSPEAKER ASSEMBLY WITH SPRING RETAINED HIGH FREQUENCY TRANSDUCER

FIELD OF INVENTION

The present invention relates generally to the field of audio system performance, and more particularly, to a loudspeaker assembly capable of pivoting the low-frequency and high-frequency transducers to provide directional sound and to avoid hindrance of sound waves by the loudspeaker frame itself.

BACKGROUND OF THE INVENTION

The home audio industry places great emphasis on convenience, and sound quality. In-wall and in-ceiling audio speakers are at the height of their popularity. While floor speakers may at times, provide superior sound quality, the aesthetic appeal of in-wall speakers and their ability to deliver high-quality sound without the need to rearrange one's living room to make space for the speakers, have created a significant demand for quality in-wall speakers that deliver the hi-fidelity sound of floor speakers.

Unfortunately, traditional in-wall speakers are mounted in a wall and therefore cannot simply be turned to redirect the sound as can be done with floor speakers, absent a great deal of effort and expense. One possible solution to such a dilemma is to make the transducers that comprise the in-wall speaker movable, so that the sound emanating from the transducers can be redirected without repositioning the entire speaker assembly.

Such designs, however, face a number of inherent difficulties. One difficulty is that a speaker designed to allow transducers to rotate may inhibit the sound emanating from the transducers, thereby causing diffraction of the sound waves. In particular, when the transducer rotates, a portion of the transducer rises above the baffle surface, while naturally the opposing portion recedes within and below the surface of the baffle. The inner "wall" created by the transducer's receding below the baffle, reflects sound emanating from the transducer. This reflection causes diffraction of the sound waves resulting in reduced quality of sound reproduction. Another difficulty is that once a speaker is mounted in the wall or in the ceiling, it is very difficult to service and/or swap the speaker out for other speakers.

As discussed above, pivotable and/or rotatable, together "swiveling," in-wall transducers would be an advantage over those which cannot be swiveled to maximize the sonic "sweet spot." A further advantage could be found in the ability interchange various speaker configurations. Ideally, the transducers should be rotatable and pivotable without causing sound diffraction.

Previous attempts have been made to provide speakers with components to direct sound for optimal listening such as are described in U.S. Pat. No. 6,101,262 to Haase et al. (the '262 patent); U.S. Pat. No. 6,070,694 to Burdett et al. (the '694 patent); U.S. Pat. No. 5,960,095 to Chang (the '095 patent); U.S. Pat. No. 5,402,502 to Boothroyd et al. (the '502 patent); U.S. Pat. No. 5,400,407 to Cassity et al. (the '407 patent); U.S. Pat. No. 5,319,364 to Shen (the '364 patent); U.S. Pat. No. 5,133,428 to Perrson (the '428 patent); U.S. Pat. No. 4,917,212 to Iwaya (the '212 patent); U.S. Pat. No. 4,884,655 to Freadman et al. (the '655 patent); U.S. Pat. No. 4,811,406 to Kawachi (the '406 patent); U.S. Pat. No. 4,553,630 to Ando (the '630 patent); U.S. Pat. No. 4,445,228 to Bruni (the '228 patent); U.S. Pat. No. 4,441,577 to Kurihara (the '577 patent); U.S. Pat. No. 4,139,734 to Fincham (the '734 patent); U.S. Pat. No. 4,182,429 to Senzaki (the '429 patent); and U.S. Pat. No. 3,976,838 to Stallings, Jr. (the '838 patent).

The '262 patent describes a panel mount speaker system including a housing having flange and wall portions, a locating portion defining a primary support surface as a concave annular spherical segment, a secondary support member defining a secondary support surface as a concave spherical segment opposite a main pivotal point; a main speaker mount having an outwardly facing primary support surface; a main speaker unit coaxially mounted to the main speaker mount; a secondary mount member fastened to the stator element of the main speaker unit and having an outwardly facing secondary engagement surface slidably engaging the secondary support surface; an auxiliary speaker; a grill structure pivotally supporting the auxiliary speaker forwardly of the main speaker unit; a crossover network connected to the main speaker unit and the auxiliary speaker; a circuit panel mounting elements of the crossover network oriented and supported perpendicular to the housing axis, the panel flexing in response to axial loading of the secondary support member for preloading sliding engagement of the main speaker axis. However, the '262 patent suffers from a number of disadvantages. For example, the main speaker unit is set very deeply into the housing, thereby causing sound distortion when in a highly pivoted position. Another disadvantage is the size of the '262 speaker system. The main speaker unit and the main speaker mount are composed of two separate pieces, this is disadvantageous relative to a speaker system that integrates the pivoting structure (main speaker mount) with the main speaker. A similarly sized pivoting speaker to the '262, that is only one piece, could occupy less space and reduce the overall size of the system.

The '694 patent, assigned to the assignee of the present application, describes a loudspeaker assembly with a transducer capable of being swiveled to direct the sound to a convenient point thereby allowing the listener to select the optimal direction of sound.

The '095 patent describes a loudspeaker assembly including a base, a supporting plate, a casing, and a loudspeaker. The supporting plate is securely mounted to the base and includes a jointing member formed on a side thereof. The casing has a first end securely engaged with the supporting plate and a second end. The loudspeaker has a first end extending beyond a second end of the casing and a second end with a planar bottom side in a universal joint connection with the jointing member on the supporting plate. The loudspeaker has a section, which is slidable relative to an inner periphery of the casing to allow adjustment of an orientation of the loudspeaker relative to the supporting plate.

The '502 patent describes sound output system comprised of a baffle, a plurality of sound drivers, and a sound mirror. The sound mirror reflects a beam of sound from the sound driver horizontally and vertically while maintaining generally consistent amplitude. One disadvantage of the '502 patent is that it requires a sound mirror to deflect sound waves rather than having the sounds waves emanating from the loudspeakers directly.

The '407 patent describes a tilt adjuster for a speaker which adjusts the position of a speaker recessed in a wall. The tilt-adjuster, preferably assembled with a speaker cover, is a wedge-shaped frame with an open central portion for receiving the speaker housing; a front side including a flattened perimeter from making abutting engagement with the speaker's housing; and a back side which attaches to the speaker's support frame. Although the '407 enables some modicum of control over the directional sound of a speaker, it is not highly adjustable, and further does not provide for a pivoting tweeter or interchangeability.

The '164 patent describes a speaker holder including a hollow, open holder body which receives a speaker within an inward top flange thereof, a bottom plate fastened to the holder body at the bottom to hold a spring-supported ball in a center hole on an upright center rod thereof for permitting the speaker to be balanced on the ball, and a mounting plate detachably fastened to the bottom plate through hooked joints for mounting the speaker holder on a supporting surface.

The '428 patent shows a direction-adjustable speaker system comprised of a sound driver disposed within a rotatable mount positioned within a housing. The mount swivels within the housing to direct the sound to a desired location.

The '212 patent describes a speaker supporting unit which includes a base and a substantially disc-shaped spacer. The spacer includes a half-round groove through which a screw can be inserted to secure the spacer to the base. The first surface of the spacer, which determines the orientation of the speaker is determined by a combination of the inclined surface of the base and the second surface of the spacer, which is varied by the relative angle between the base and the spacer. One disadvantage of the '212 patent is that it requires a spacer to determine the direction of sound projection and is not adjustable without removing the speaker and inserting a new spacer.

The '655 patent describes a speaker cabinet having a pair of front wall segments and adjacent to the ends of the cabinet, and an intermediate forwardly opening cavity extending between the upper and lower front wall segments, a pair of large subwoofer speakers in the upper and lower front wall segments; and a swiveled movable center subcabinet having a woofer, mid-range speaker and a pair of tweeters. The subcabinet has a range of swivel movement horizontally about a vertical axis. The '655 patent suffers from its inability to rotate to reposition the speaker. It merely swivels thereby creating possible sound distortion when at its furthest position from center. In addition, the unit is bulky and would be difficult to mount in an automobile, wall or ceiling.

The '406 patent describes a compound speaker system comprising a woofer, a squawker, a tweeter, and a super tweeter. The squawker, tweeter and super tweeter are attached to a plate and this assembly is rotatably positioned within the cone of the woofer. The system can be designed where the tweeter and super tweeter are at an elevated position with respect to the squawker when the assembly is rotated within the cone of the woofer. One disadvantage of the '406 patent is that it does not provide for a woofer capable of variably directing sound. The '406 patent also does not provide for interchangeable speaker configurations within a wall, ceiling, or vehicle setting.

The '630 patent describes a speaker with a tweeter angle adjusting device. The tweeter can change direction by use of horizontal and vertical adjusting knobs and which are secured to horizontal shaft and vertical shafts, respectively, through the use of interlocking mechanisms. One disadvantage of the '630 patent is that it rotates the tweeter only, it does to describe a rotating woofer as well. In addition, the position means is through twisting knobs which require more effort than a simple pivot.

The '228 patent shows a stereo audio system for a motorcycle including a housing for a radio receiver and speaker-mirror assemblies, mounted on base-socket assemblies, and threaded over mounting posts screwed into holes in the handlebars. This patent is specifically tailored for use in motorcycles and only pivots in one direction to provide sound while the motorcycle is in motion.

The '577 patent describes a direction-variable speaker system for car-audio devices comprising two speaker cases containing speaker units for different reproduction bands, and an intermediate case interposed between the two speaker cases. A first pivotal shaft and a rising angle setting mechanism connect the first speaker case with the intermediate case. Between the second speaker case and the intermediate case is a second pivotal shaft as well as a twisting angle setting mechanism. By using the rising angle and twisting angle mechanisms, both speaker cases can be varied with respect to their angles in rising amount and twisting amount. The '577 includes multiple speakers but these speakers are not mounted in the same axis for sound projection. Additionally, there is no provision for interchangeability of configurations and the woofer is incapable of variable directional sound.

The '734 patent describes a pivoting loudspeaker with a plurality of enclosures, wherein at least one of the enclosures is pivotably mounted with respect to another of the enclosures, and a light emitting device which is visible through an aperture only when a listener is in correct listening position. The '734 patent suffers from raised speaker sound diffraction and also cannot pivot the low frequency speaker without moving the entire system.

The '429 patent shows a loud-speaker system particularly suitable for use in car stereo systems, comprising at least a tweeter, with a woofer arranged coaxially to the tweeter wherein the tweeter is adjustably mounted to the woofer in order to allow manual regulation of the position of the tweeter to that of the woofer.

The '838 patent describes a sound reproduction system comprised of a plurality of speakers, said system being mounted in a wall.

None of the devices mentioned above describe a loudspeaker assembly with a swiveling high frequency transducer capable of rotating and pivoting in any direction in combination with a pivoting low frequency transducer, and interchangeable with various other speaker configurations.

Therefore, there is a need in the art for a loudspeaker assembly with a swiveling high frequency transducer capable of rotating and pivoting in any direction in combination with a pivoting low frequency transducer to obtain optimal dispersion control after installation of the speaker.

There is a further need in the art for a loudspeaker assembly which can be mounted in the baffle of an in-wall speaker and direct the sound to obtain the "sweet spot" without any diffraction or distortion of sound caused by the sound waves radiating off the sharp inner edge of the baffle created by the swiveling of the transducers.

There is a further need in the art for a loudspeaker assembly that can allow a listener to swivel the transducers to obtain optimal dispersion control after installation of the speaker within a vehicle.

There is a further need in the art for a loudspeaker assembly having the features of the present invention whereby the loudspeaker assembly is a free-standing floor speaker.

There is a further need in the art for a loudspeaker assembly that can be easily replaced by a speaker assembly of an alternate configuration.

SUMMARY OF THE INVENTION

The present invention fills these needs by providing an interchangeable loudspeaker assembly capable of providing unobstructed directional sound.

In a preferred embodiment, what is provided is a loudspeaker assembly, comprising a frame for removably attaching transducer assemblies; a tweeter assembly; means to rotate and pivot the tweeter assembly, such that the tweeter assembly rotates and pivots without causing sound diffraction by the frame for removably attaching transducer assemblies; a woofer assembly; and means to rotate and pivot the woofer assembly, such that the woofer assembly rotates and pivots without causing sound diffraction by the frame for removably attaching transducer assemblies.

In an alternate embodiment, the loudspeaker assembly comprises a frame for removably attaching transducer assemblies; a tweeter assembly, comprising a tweeter post, a retaining spring, a tweeter post cap, a tweeter ball bottom, a high frequency transducer, and a tweeter ball top; means to rotate and pivot said tweeter assembly, such that the tweeter assembly rotates and pivots without causing sound diffraction by the frame for removably attaching transducer assemblies; a woofer assembly, comprising a woofer frame retainer, a woofer frame, and a twist lock baffle; means to rotate and pivot said woofer assembly, such that the woofer assembly rotates and pivots without causing sound diffraction by the frame for removably attaching transducer assemblies; and, grilles for protection and appearance.

Accordingly, it is an object of the present invention to provide a loudspeaker assembly with a swiveling high frequency transducer capable of rotating and pivoting in any direction in combination with a pivoting low frequency transducer to obtain optimal dispersion control after installation of the speaker.

It is another object of the present invention to provide a loudspeaker assembly which can be mounted in the baffle of an in-wall speaker and direct the sound to obtain the "sweet spot" without any diffraction or distortion of sound caused by the sound waves radiating off the sharp inner edge of the baffle created by the swiveling of the transducers.

It is another object of the present invention to provide a loudspeaker assembly that can allow a listener to swivel the transducers to obtain optimal dispersion control after installation of the speaker within a vehicle.

It is another object of the present invention to provide a loudspeaker assembly having the features of the present invention whereby the loudspeaker assembly is a free-standing floor speaker.

It is another object of the present invention to provide a loudspeaker assembly that can be easily replaced by a speaker assembly of an alternate configuration.

This and other objects, features and advantages of the present invention may be better understood and appreciated from the following detailed description of the embodiments thereof, selected for purposes of illustration and shown in the accompanying drawings.

DETAILED DESCRIPTION OF THE PREFERRED EMBODIMENT

Figure 1A:
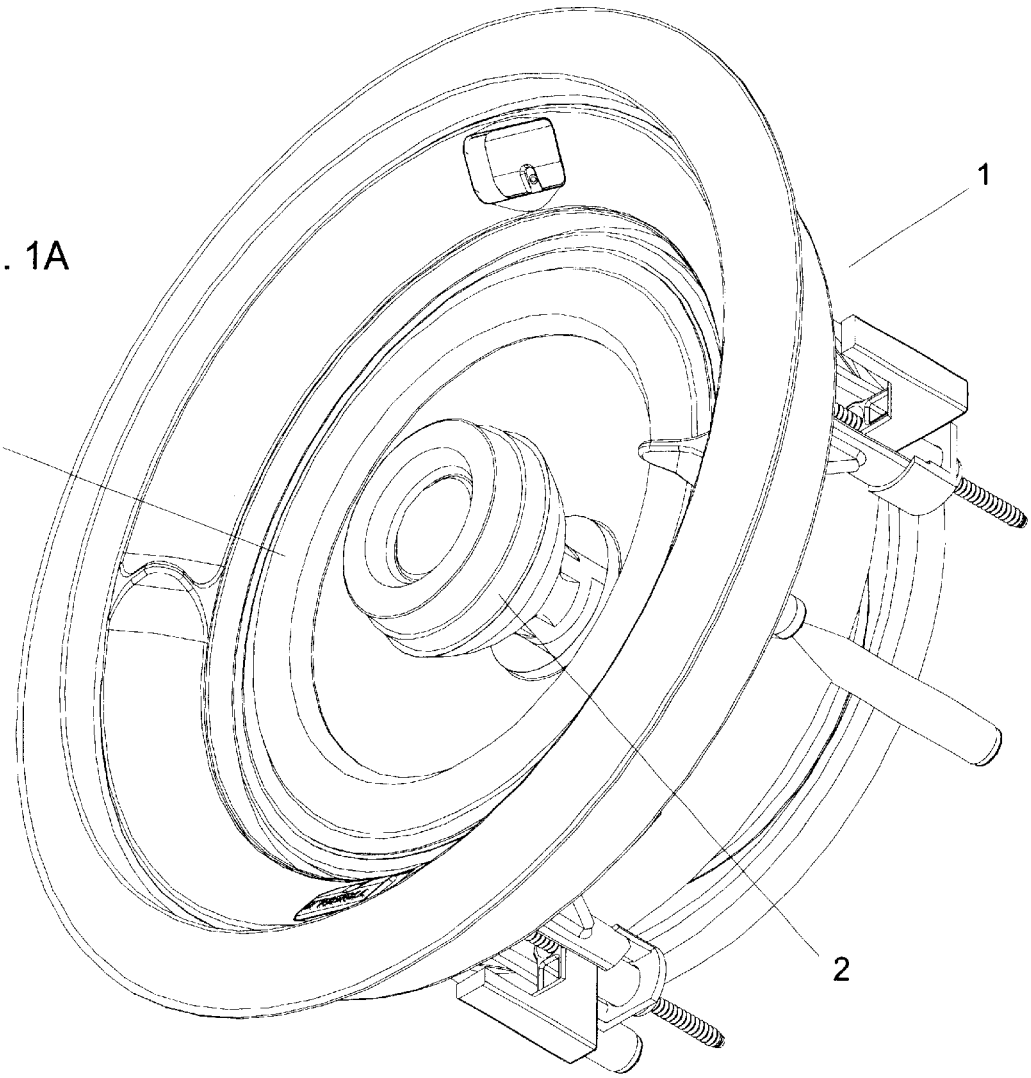
FIG. 1A is a front perspective view of a preferred embodiment of the speaker assembly according to the invention.
Figure 6:
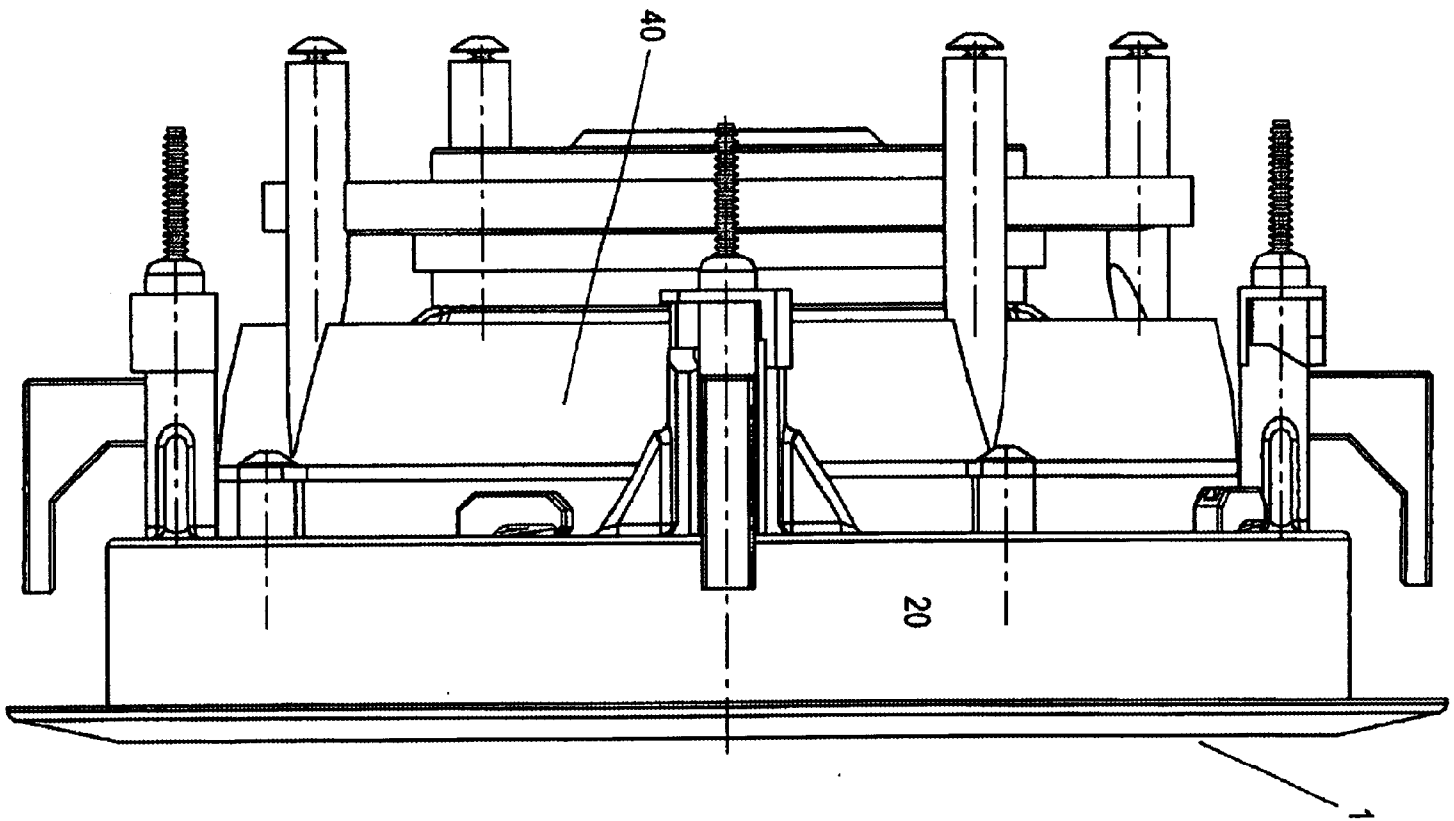
FIG. 6 is a side view of a preferred embodiment of the speaker assembly according to the invention.

Referring initially to FIG. 1A of the drawings, in which like numerals indicate like elements throughout the several views, in a preferred embodiment what is provided is a loudspeaker assembly 1 that allows for a pivoting low-frequency transducer to be used in combination with a spring retained, pivoting high-frequency transducer 12. In this perspective view, the entire loudspeaker assembly 1 is illustrated. The positional relationship between the tweeter assembly 2 (comprising elements 10–16, 44, and 46) and the woofer assembly 4 (comprised of elements 18–42) is illustrated in further detail in FIG. 3. A side view can be seen in FIG. 6. Although a pivoting high frequency transducer 12 and a pivoting low frequency transducer (comprising elements 24–38) are described, alternate embodiments could include a non-pivoting high frequency transducer and a pivoting low frequency transducer in combination or vice-versa, such that only one of the pair of transducers pivots.

Figure 1B:
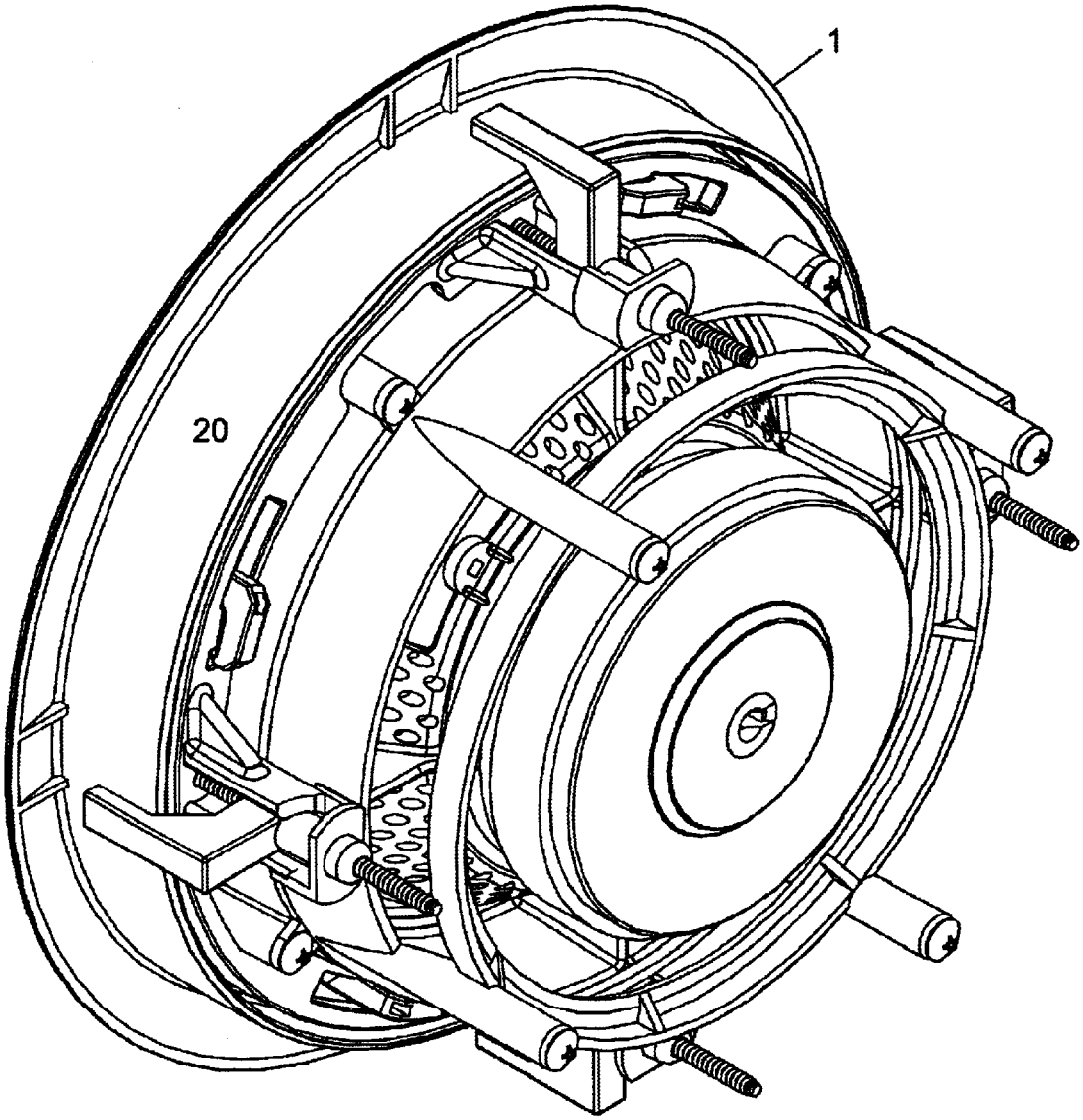
FIG. 1B is a rear perspective view of a preferred embodiment of the speaker assembly according to the invention.

FIG. 1B illustrates the twisting lock style fastening baffle 18 and the frame 20 in operation. The tweeter assembly 2 and the woofer assembly 4 can be removed from the frame 20 and replaced with a different loudspeaker configuration by simply twisting them until the locking arms of the twist lock baffle 18 can pass through the insertion holes in the frame 20. The effectiveness of the locking arms of the twist lock baffle can be enhanced by biasing the arms such that, in the locked position, the locking arms exert themselves into fastening holes located on the frame 20. The transducer assemblies 2, 4 could also alternatively be removably mounted using snap-in clips or other similar means known to those who are skilled in the art of loudspeaker assembly, installation and mounting.

Figure 2:
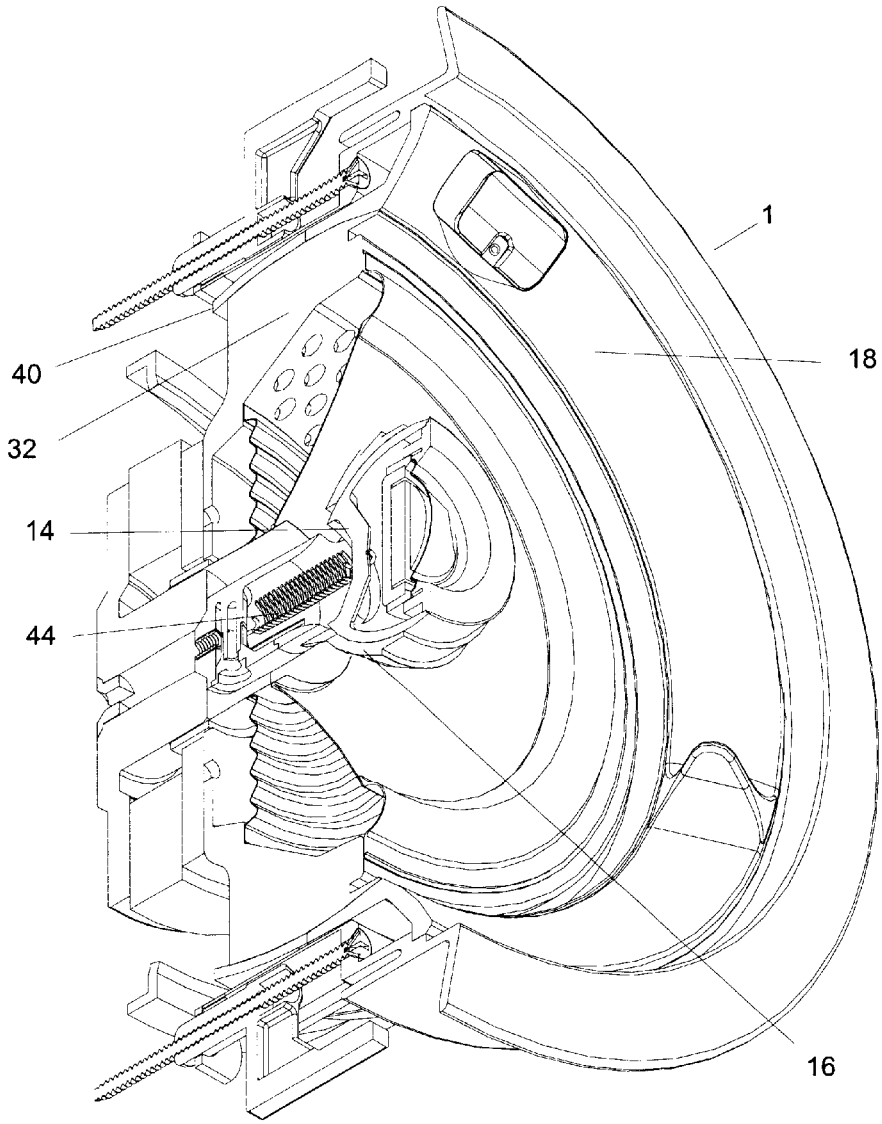
FIG. 2 is a cross-sectional view of a preferred embodiment of the speaker assembly according to the invention.

Referring now to FIG. 2, a perspective, cross-sectional view of the loudspeaker assembly 1 illustrates the tweeter assembly 2 mounted in the woofer assembly 4. The retaining spring 44 is shown holding the tweeter ball bottom 14 in place within the tweeter post 16. The woofer frame 32 abuts the woofer frame retainer 40 and the twist lock baffle 18. A compression fit allows for pivoting of the woofer assembly 4 and the high frequency transducer 2 assembly mounted thereon. The high frequency transducer 12 can be pivoted separately using the friction fit, caused by the downward force exercised on the tweeter ball bottom 14 by the retaining spring 44, between the tweeter ball bottom 14 and the tweeter post 16.

Figure 3:
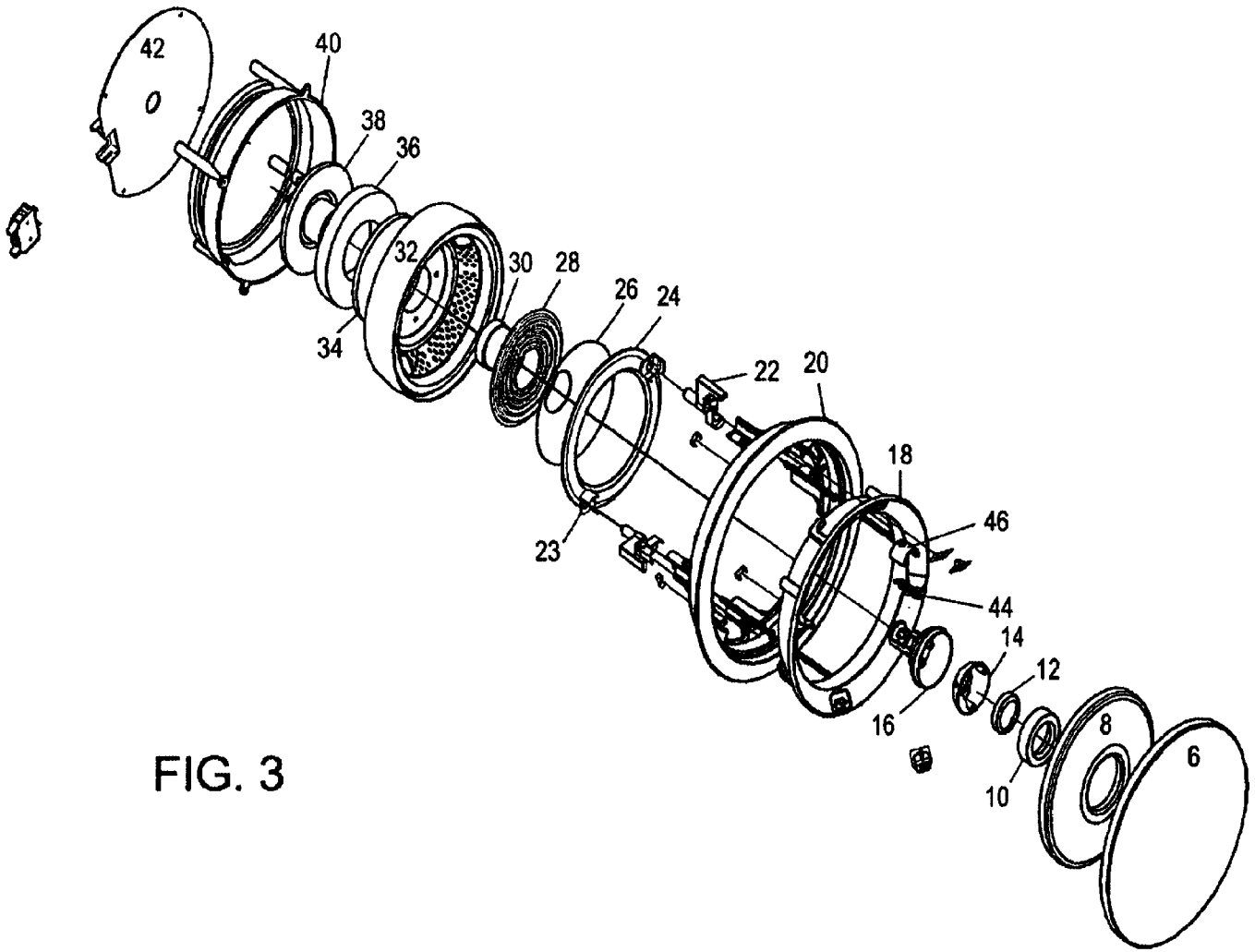
FIG. 3 is a front perspective, exploded view of a preferred embodiment of the speaker assembly according to the invention.
Figure 4:
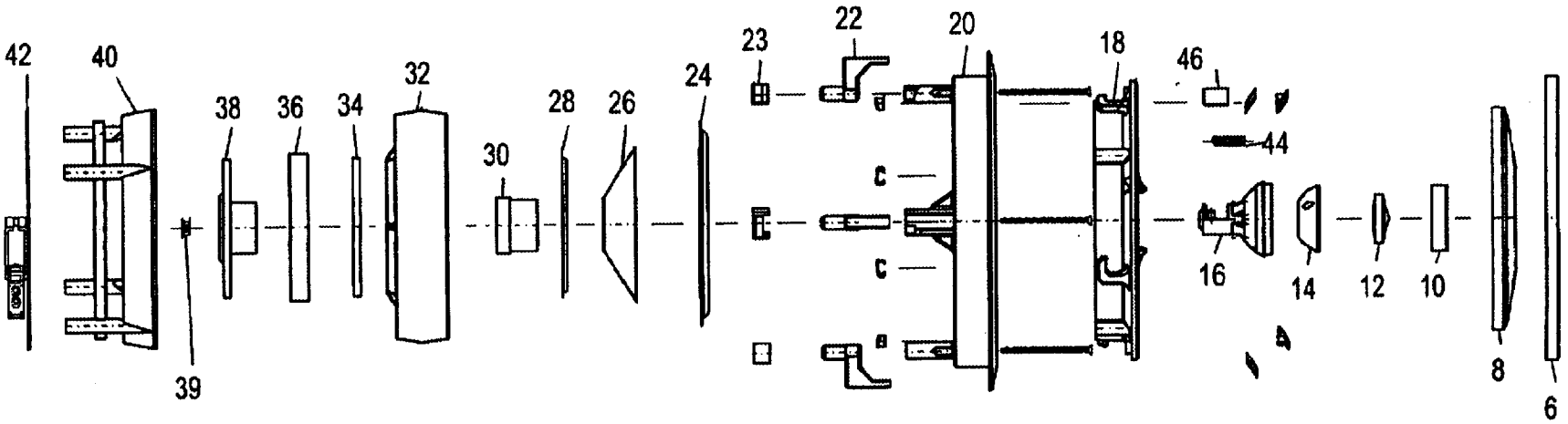
FIG. 4 is a side, exploded view of a preferred embodiment of the speaker assembly according to the invention.

FIG. 3 illustrates the positional relationship between all the component parts of the present invention 1. The PCB Assembly 42 directs high frequency signals to the high frequency transducer and low frequency signals to the low frequency transducer. The PCB Assembly is secured to the woofer frame retainer 40, the woofer frame retainer holding in place the purely cosmetic back plate plug 39, the back plate 38, the magnet 36, the top plate 34 and the woofer frame 32. The back plate 38 is shaped so that the pole section fits through a circular hole cut out of the middle of the magnet 36. The woofer frame 32 holds in position the low frequency transducer, which is comprised of a debris screen 31, a coil 30, a spider 28 (used in conjunction with the surround 24 to suspend the cone 26 at top and bottom). The twist lock baffle 18 is fastened to the woofer frame retainer 40, and the woofer assembly 4 is removably attachable to the frame 20. The twist lock baffle 18 and the frame 20 are positioned such that, in the maximally pivoted position, sound waves emitted from the low frequency transducer are not distorted. The frame 20 is ideally attached to a wall, for example in a home, using dogleg clamps 22 and dogleg clamp retainers 23. The frame 20 can also be used in automobile or incorporated into a freestanding loudspeaker. Attached to the woofer assembly 4, is the tweeter assembly 2. The tweeter assembly 2 is comprised of elements 10–16, 44 and 46. The tweeter post 16 is connected to the back plate 38. Within the tweeter post is the retaining spring 44, the spring being held in place by the tweeter post cap 46. The spring 44 extends the length of the tweeter post 16 attaching to the underside of the tweeter ball bottom 14. The tweeter ball bottom 14 holds the high frequency transducer 12 in place. The tweeter ball top 10 is attached to the tweeter post 16 and holds the High frequency transducer 12 and the tweeter ball bottom 14 within the cavity formed by the post 16 and the top 10. The upper portion of the post 16 is formed like a cup, and the tweeter ball bottom 14 is formed to match that shape. The fit between the ball bottom 14 and the post 16, in addition to the downward pull applied by the spring 44 on the ball bottom 14, allow the high frequency transducer 12 to be pivoted, where it will remain until being repositioned. In addition, the present invention provides movement of the high frequency transducer 12 such that there is no sound distortion caused by the tweeter ball bottom 14 or the frame 20 as the transducer 12 is at its maximally pivoted position. Capping off the assembly 1 are perforated metal grilles, 6, 8 which serve the dual purpose of protecting the assembly 1 and providing an aesthetic appearance. FIG. 4 illustrates all these component parts from a side view.

Figure 5:
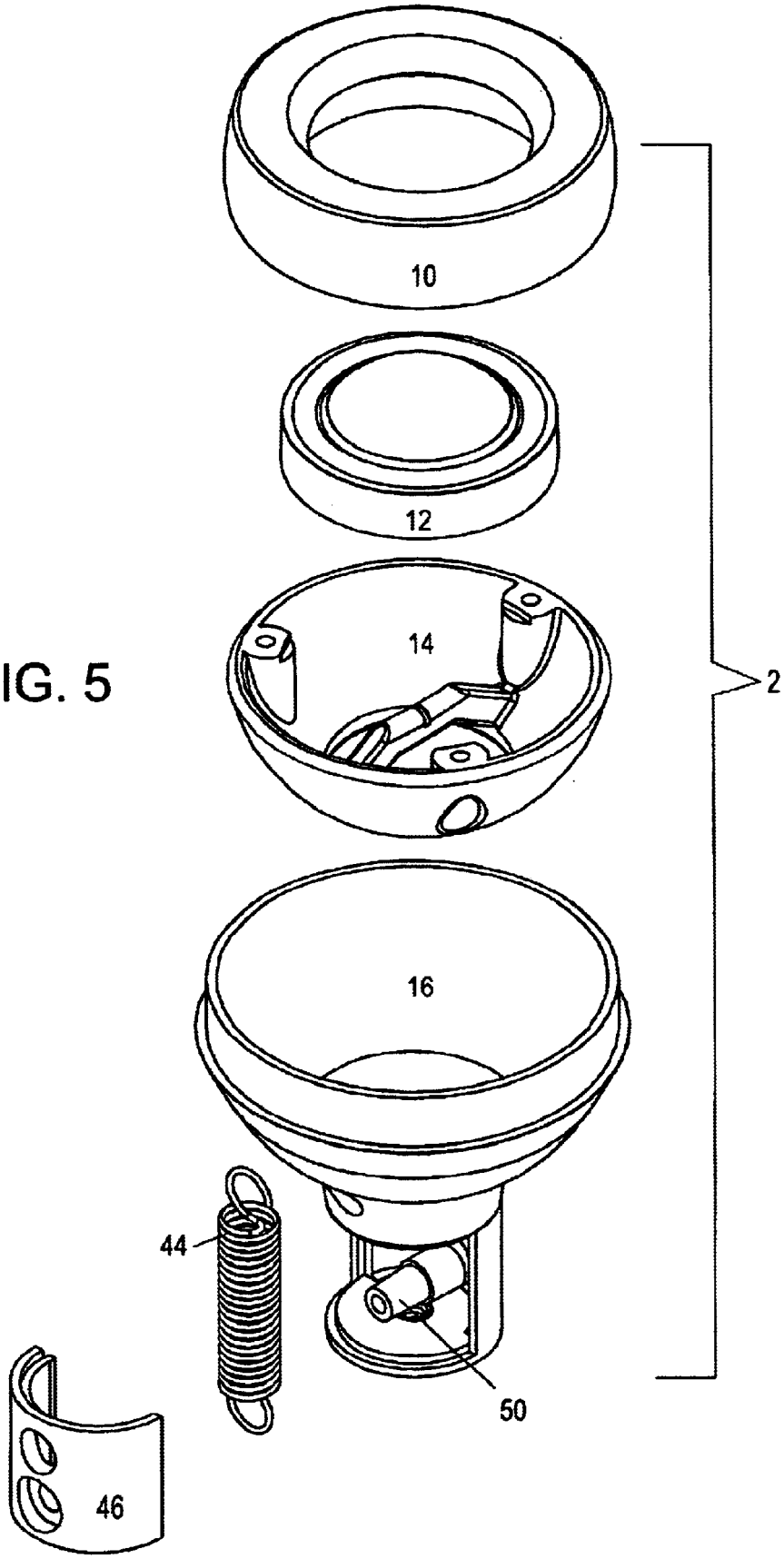
FIG. 5 is an exploded view of a preferred embodiment of the spring retained transducer assembly according to the invention.

Turning to FIG. 5, the protrusion 50 at the bottom of the tweeter post 16 passes through the bottom loop of the retaining spring 44. The spring 44 is maintained in place by securing the open end of the protrusion 50 with the tweeter post cap 46. The retaining spring proceeds through the central hollow portion of the tweeter post 16, where it attaches its uppermost loop to a cross-member 52 in the tweeter ball bottom 14. The retaining spring 44 pulls the tweeter ball bottom 14 towards the upper surface of the tweeter post 16. The tweeter ball bottom is shaped like a cup and fits within the slightly larger cup shape of the tweeter post 16. There is enough downward force exerted by the retaining spring 44, that if the tweeter ball bottom 14 is pivoted, it remains in a pivoted position until moved again. Inside the tweeter ball bottom 14 rests the high frequency transducer 12. The tweeter assembly 2 is capped by a tweeter ball top 10, which is secured to the tweeter post 16.

Accordingly, it will be understood that the preferred embodiment of the present invention has been disclosed by way of example and that other modifications and alterations may occur to those skilled in the art without departing from the scope and spirit of the appended claims.

What is claimed is:

1. A loudspeaker assembly, comprising:

a frame for removably attaching transducer assemblies;

a rotating and pivoting high frequency transducer, such that said high frequency transducer rotates and pivots in relation with said frame for removably attaching transducer assemblies without causing sound diffraction by said frame for removably attaching transducer assemblies;

a woofer frame retainer attached to said frame for removably attaching transducer assemblies;

a twist lock baffle attached to said frame for removably attaching transducer assemblies;

a woofer frame disposed so as to enclose and, support a low frequency transducer, said woofer frame being disposed between said woofer frame retainer and said twist lock baffle under a compression fit;

whereby said woofer frame retainer and said twist lock baffle are fixed in relation to said frame for removably attaching transducer assemblies;

whereby said woofer frame and said low frequency transducer rotate and pivot in relation to said frame for removably attaching transducer assemblies without causing sound diffraction by said frame for removably attaching transducer assemblies;

whereby said compression fit between said woofer frame, said woofer frame retainer and said twist lock baffle result in a frictional resistance to said rotation and pivoting of said woofer frame and said low frequency transducer in relation to said frame for removably attaching transducer assemblies;

grilles mounted on said frame for removably attaching transducer assemblies for protection and appearance.

2. The loudspeaker assembly of claim 1, wherein said assembly is capable of being mounted in a wall.

3. The loudspeaker assembly of claim 1, wherein said assembly is capable of being mounted in a ceiling.

4. The loudspeaker assembly of claim 1, wherein said assembly is capable of being mounted in a vehicle.

5. The loudspeaker assembly of claim 1, wherein said assembly is capable of being mounted in a freestanding loudspeaker unit.

6. The loudspeaker assembly of claim 1, wherein said assembly further comprises a PCB Assembly, a back plate plug, a back plate, a magnet, a top plate, a coil, a spider, a cone, and a surround.

7. A pivoting woofer assembly, comprising:

a mounting frame;

a woofer frame retainer attached to said mounting frame;

a twist lock baffle attached to said mounting frame;

a woofer frame and a low frequency transducer enclosed within and fixed in relation to said woofer frame, said woofer frame being disposed between said woofer frame retainer and said twist lock baffle under a compression fit;

whereby said woofer frame retainer and said twist lock baffle are fixed in relation to said mounting frame;

whereby said woofer frame and said low frequency transducer rotate and pivot in relation to said mounting frame; and whereby said compression fit between said woofer frame, said woofer frame retainer and said twist lock baffle result in a frictional resistance to said rotation and pivoting of said woofer frame and said low frequency transducer in relation to said mounting frame.

8. A pivoting tweeter assembly, comprising:

a mounting frame;

a tweeter post attached to said mounting frame;

a tweeter ball formed from a tweeter ball top, tweeter ball bottom and a high frequency transducer enclosed therebetween, said high frequency transducer being fixed in relation to said tweeter ball top and said tweeter ball bottom; and a retaining spring pulling said tweeter ball and said tweeter post, said spring being biased so as to cause said tweeter post and said tweeter ball to abut;

whereby said tweeter post is fixed in relation to said mounting frame;

whereby said tweeter ball and said high frequency transducer rotate and pivot in relation to said mounting frame; and whereby the abutting interface between said tweeter post and said tweeter ball result in a frictional resistance to said rotation and pivoting of said tweeter ball and said high frequency transducer in relation to said mounting frame.

* * * * *